United States Patent [19]

Meeuwssen

[11] Patent Number: 4,924,146

[45] Date of Patent: May 8, 1990

[54] UNSATURATED HIGH-PRESSURE SODIUM LAMP

[75] Inventor: Marina M. J. Meeuwssen, Eindhoven, Netherlands

[73] Assignee: U.S. Philips Corporation, New York, N.Y.

[21] Appl. No.: 309,466

[22] Filed: Feb. 10, 1989

[30] Foreign Application Priority Data

Feb. 10, 1988 [NL] Netherlands ..... 8800323

[51] Int. Cl.[5] ..... H01J 61/22; H01J 61/26

[52] U.S. Cl. ..... 313/638; 313/549; 313/562; 313/642; 252/181.4; 252/181.7; 445/38; 445/41; 445/53

[58] Field of Search ..... 313/549, 562, 638, 642; 252/181.4, 181.7; 445/21, 38, 41, 53, 55

[56] References Cited

U.S. PATENT DOCUMENTS 3,433,477 7/1969 Hanneman et al. ..... 313/638
3,558,963 1/1971 Hanneman ..... 313/638
4,333,032 6/1982 Wyner et al. ..... 445/41 X
4,380,714 4/1983 Bouman et al. ..... 313/549

FOREIGN PATENT DOCUMENTS 122052 10/1984 European Pat. Off. ..... 313/562

*Primary Examiner*—Donald J. Yusko
*Assistant Examiner*—Michael Horabik
*Attorney, Agent, or Firm*—Emmanuel J. Lobato; Brian J. Wieghaus

[57] ABSTRACT

The invention relates to an unsaturated high-pressure sodium lamp provided with a discharge vessel enclosing a discharge space, having a ceramic wall and closed at both ends by a leadthrough element to which an electrode is secured, and at least one electrode provided with emitter material. The fill material within the discharge vessel contains sodium, mercury and a rare gas. According to the invention, the discharge space also contains in metallic form one or more of the elements Mg, Ca, Sr and Ba up to at most 10% by weight of the mercury metered.

3 Claims, 1 Drawing Sheet

UNSATURATED HIGH-PRESSURE SODIUM LAMP

BACKGROUND OF THE INVENTION

The invention relates to an unsaturated high-pressure sodium lamp of the type having a discharge vessel enclosing a discharge space, and discharge electrodes therein. At least one electrode is provided with emitter material and the discharge vessel contains a fill material comprising sodium, mercury and a rare gas. The invention further relates to a method of manufacturing such a lamp.

The term "ceramic wall" is to be understood herein to mean a wall formed by translucent crystalline metal oxide which may be either monocrystalline (for example sapphire) or polycrystalline. Known polycrystalline metal oxides in this respect are aluminium oxide and yttrium aluminium garnet. In polycrystalline form the material is sintered to gas-tightness. Such a lamp is known from U.S. Pat. No. 3,453,477.

In the known lamp formation of sodium aluminate is counteracted by a suitable choice of the temperature and the composition ratio of Na/Hg in the lamp fill material. However, experiments have shown that not only the metal oxide of the ceramic wall gives rise to the disappearance of Na from the fill material, but also that a number of oxygen sources give rise to the disappearance of sodium. A very important source is found to be emitter material, for instance in the case in which this material contains alkaline earth metal oxide, or for instance yttrium oxide. Thus, it has been found that the use of such an emitter material results in a substantial disappearance of sodium during the first hundred hours of lamp operation and in a small, but continuing disappearance thereof during further lamp operation. Although a number of metals are known to function as an oxygen getter in a lamp discharge space, these metals do not lead in the presence of emitter material to an acceptable suppression of the processes extracting sodium from the fill component and from the discharge space.

Although it is conceivable in principle to compensate the loss of Na occurring at the beginning of the lamp life by increasing the quantity of Na in the initial fill material, it is thus hardly possible in practical conditions to manufacture lamps on an industrial scale in a reproducible manner. Moreover, also in this case the lamp will exhibit a changing behavior during the first hours of its life.

SUMMARY OF THE INVENTION

The invention has for its object to provide a measure by which it is possible to obtain an unsaturated high-pressure sodium lamp provided with electrodes comprising emitter material while maintaining satisfactory light properties, lamp parameters and a long life.

For this purpose, according to the invention, an unsaturated high-pressure sodium lamp of the kind mentioned in the opening paragraph is characterized in that one or more of the elements Mg, Ca, Sr and Ba are provided in open communication with the discharge space, in metallic form and in a quantity up to at most 10% by weight of the Hg present in the discharge space.

A surprising advantage is that the disappearance of sodium is limited to a minimum and difficulties in operation due to, for example, the formation of amalgam do not occur. A possible explanation is that the metal elements have a comparatively high vapor pressure. Also, because of the direct contact with the gas filling vapor of the metals will be distributed through the whole discharge space, which strongly promotes a rapid getter effect. This is in sharp contrast with the use of the metals surrounded by a holder previous only to oxygen. Moreover, it appears that no influencing of the spectrum of the light emitted by the lamp occurs with respect to the illumination source. If a larger quantity of metal than 10% by weight with respect to Hg is provided in the discharge space, the necessarily occurring formation of amalgam will at least delay the build-up of a desired mercury pressure and problems arise which are known from the literature. See, U.S. Pat. No. 3,558,963.

Ba, Ca and Sr are known as fill material components for influencing with respect to the illumination source the spectrum of the light emitted by the lamp. The quantities required to this end are such, however, that on the one hand excess filling can hardly be avoided in connection with amalgam formation, while on the other hand a substantial attack on the ceramic wall takes place due to reactions between the relevant metal vapor and the metal oxide of the ceramic wall.

In order that a sufficient oxygen getter effect is ensured also during the life of the lamp, in practice at least 0.5% by weight is supplied with respect to the metered quantity of Hg.

A lamp according to the invention, in which at least one electrode is provided with emitter material, is preferably manufactured by a method comprising the following steps of securing in a gas-tight manner a first leadthrough element provided with an electrode in a first end of the discharge vessel, metering mercury and sodium into the discharge vessel, filling the discharge vessel with a rare gas to a pressure corresponding to the desired pressure in the finished lamp, providing a quantity of metal of one or more of the elements Mg, Ca, Sr and Ba, and securing in a gas-tight manner a second leadthrough element provided with an electrode in a second end of the discharge vessel.

In the preferred method, the leadthrough elements constitute a hermetic seal already when being secured in the discharge vessel. Temperature control of the discharge space can then be realized entirely within the space enclosed by the ceramic wall of the discharge vessel, which is generally advantageous.

The construction of a discharge vessel provided with leadthrough elements obtained by this method is known. Especially in high-pressure sodium lamps whose filling is partly saturated during operation, this construction is frequently used. The use of the same construction in an unsaturated high-pressure sodium lamp therefore has the great advantage that it is possible to use the same production method and hence the same machines and tools for the manufacture of both lamp types.

In a preferred method, the quantity of metal of one or more of the elements Mg, Ca, Sr and Ba is provided simultaneously with at least the step of metering mercury in the form of an amalgam. This can be effected advantageously because, due to the small quantity of metal, liquid amalgam having a comparatively low boiling trajectory will readily be obtained.

BRIEF DESCRIPTION OF THE DRAWING

An embodiment of a lamp according to the invention will be described more fully with reference to a drawing, in which.

DETAILED DESCRIPTION OF THE INVENTION

Figure 1:
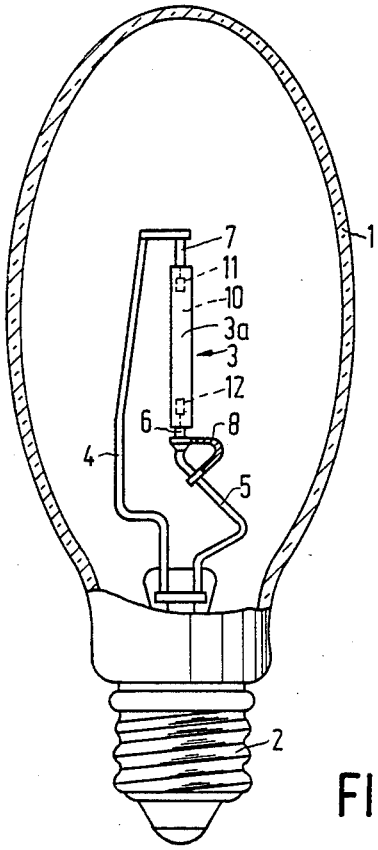
FIG. 1 is a side elevation of the lamp according to the invention.

In FIG. 1, a discharge vessel 3 enclosing a discharge space 10 is arranged in a glass outer envelope 1 provided with a lamp cap 2 between current conductors 4, 5. The discharge vessel has a ceramic wall 3*a* provided on both sides with leadthrough elements 6, 7 secured in a gas-tight manner. The leadthrough elements 6, 7 are in the form of niobium sleeves. Within the discharge vessel 3, the leadthrough elements 6 and 7 are each provided with an electrode 11, 12, between which electrodes the discharge extends in the operating condition of the lamp. The electrodes 11, 12 each contain emitter material. The current conductor 5 passes with a certain amount of clearance into the niobium sleeve 6. A good electrical contact between the two is guaranteed by a metal wire 8, for example of nickel or niobium.

The fill material in the discharge vessel of one example of the invention consists essentially of 3.6 mg of mercury, 0.025 of Na, 100 $\mu$g of Mg and having at 300 K a pressure of 13.3 kPa. The discharge vessel has an inner length of 82 mm and an inner diameter of 6.8 mm. The lamp described has a nominal power of 220 W and is suitable to be operated by a supply source of 220 V, 50 Hz.

The lamp described is manufactured by means of a method, in which the leadthrough element 7 is secured by means of melting glass in a gas-tight manner to the wall 3*a* of the discharge vessel. The melting glass used consists essentially of 45.4% by weight of $Al_2O_3$, 5.6% by weight of MgO, 38.6% by weight of CaO, 8.7% by weight of BaO and 1.7% by weight of $B_2O_3$. Sixteen mg is used.

Subsequently, the discharge vessel 3 is filled with Hg and Na in the quantities described. The discharge vessel is then arranged in a xenon atmosphere of 23.5 kPa at 267° C., which corresponds to 13.3 kPa at 300 K. Next, a rod formed from Mg having a mass of 100 $\mu$g is arranged in the discharge vessel together with the leadthrough element 6, whereupon the leadthrough element 6 is secured in the discharge vessel in the same gas-tight manner as the leadthrough element 7. Both electrodes 11, 12 are provided with tri-barium yttrium tungstenate as emitter material.

Figure 2:
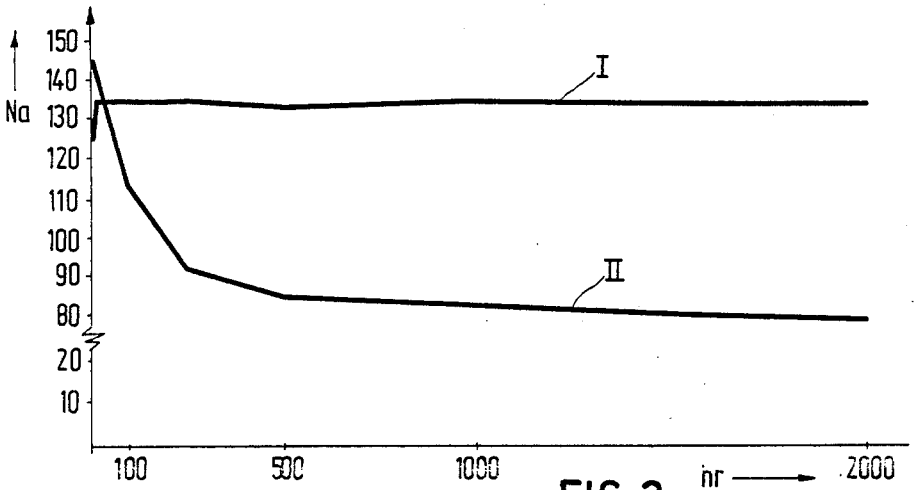
FIG. 2 shows the variation of the quantity of sodium in the discharge as a function of the life of the lamp.

In FIG. 2, the quantity of sodium in the discharge vessel is plotted on the ordinate (expressed in an arbitrary relative unit). The operating life of the lamp in hours is plotted on the abscissa. The curve I for the lamp according to the invention demonstrates that the quantity of sodium remains constant for a substantial part of the life of the lamp. The curve II is for a lamp of a corresponding type, but with omission of Mg from the filling of the discharge vessel. It is clear that the quantity of sodium in the lamp without Mg strongly decreases immediately at the beginning of the lamp life and then remains at a low level.

What is claimed is:

1. An unsaturated high-pressure sodium lamp provided with a discharge vessel enclosing a discharge space and having a ceramic wall and closed at both ends by a leadthrough element, a respective electrode secured to each leadthrough element, at least one electrode provided with emitter material, the discharge vessel having a filling containing sodium and at least mercury and a rare gas, characterized in that at least one of the elements of the group consisting of Mg, Ca, Sr and Ba is provided in open communication with the discharge space in metallic form up to at most 10% by weight of the Hg present in the discharge space.

2. A method of manufacturing an unsaturated high-pressure sodium lamp as claimed in claim 1, in which at least one electrode is provided with emitter material, characterized in that the method comprises the following steps:

securing in a gas-tight manner a first leadthrough element provided with an electrode in a first end of the discharge vessel, metering mercury and sodium into the discharge vessel, filling the discharge vessel with a rare gas up to a pressure corresponding to the desired pressure in the finished lamp, providing a quantity of metal of one or more of the elements Mg, Ca, Sr and Ba, and securing in a gas-tight manner a second leadthrough element provided with an electrode in a second end of the discharge vessel.

3. A method as claimed in claim 2, characterized in that the step of providing the quantity of metal of one or more of the elements Mg, Ca, Sr and Ba is carried out simultaneously with at least the step of metering mercury in the form of amalgam.

* * * * *